US008179351B2

(12) United States Patent
Song et al.

(10) Patent No.: US 8,179,351 B2
(45) **Date of Patent: *May 15, 2012**

(54) LIQUID CRYSTAL DISPLAY AND DRIVING METHOD THEREOF

(75) Inventors: Hongsung Song, Gumsi-si (KR); Woongki Min, Daegu (KR); Yonggi Son, Milyang-si (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 727 days.

This patent is subject to a terminal disclaimer.

(21) Appl. No.: 12/318,285

(22) Filed: Dec. 23, 2008

(65) Prior Publication Data

US 2009/0179845 A1 Jul. 16, 2009

(30) Foreign Application Priority Data

Dec. 29, 2007 (KR) ..... 10-2007-0141126

(51) Int. Cl.
*G09G 3/36* (2006.01)

(52) U.S. Cl. ..... 345/96; 345/90

(58) Field of Classification Search ..... 345/87, 345/90, 94, 96, 99, 103, 208, 209
See application file for complete search history.

(56) References Cited

U.S. PATENT DOCUMENTS

| | | | | |
|---|---|---|---|---|
| 5,998,724 | A * | 12/1999 | Takeuchi et al. | 84/622 |
| 2005/0264508 | A1 | 12/2005 | Nakamura et al. | |
| 2005/0285837 | A1* | 12/2005 | Akimoto | 345/96 |
| 2007/0120810 | A1* | 5/2007 | You et al. | 345/103 |
| 2008/0143901 | A1* | 6/2008 | Kim | 349/38 |
| 2008/0170024 | A1* | 7/2008 | Song et al. | 345/96 |
| 2008/0170025 | A1* | 7/2008 | Song et al. | 345/96 |
| 2008/0204390 | A1* | 8/2008 | Moon | 345/87 |
| 2008/0316161 | A1* | 12/2008 | Song et al. | 345/95 |
| 2009/0167664 | A1* | 7/2009 | Song et al. | 345/94 |

FOREIGN PATENT DOCUMENTS

CN 1705006 A 12/2005

* cited by examiner

*Primary Examiner* — Ricardo L Osorio
(74) *Attorney, Agent, or Firm* — McKenna Long & Aldridge, LLP

(57) ABSTRACT

A liquid crystal display and a method of driving the same are disclosed. A timing controller of the liquid crystal display controls a polarity control signal to have a different phase in each frame and allows liquid crystal cells to be divided into a first liquid crystal cell group charged to a data voltage of a same polarity during two frame periods and a second liquid crystal cell group charged during a current frame period to the data voltage with a polarity opposite a polarity of the data voltage charged during a previous frame period. The liquid crystal cells belonging to the first liquid crystal cell group are successively charged to the data voltage of the same polarity during three or more frame periods at intervals of a predetermined time equal to or longer than two frame periods.

10 Claims, 19 Drawing Sheets

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| POL | + | − | + | − | + | − | + | + | − | + | − | + | − | + | − | − | + | − | + | − | + | − | + | + | − | + | − | + | − | + |

| Frame | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|
| POL | − | − | + | − | + | − | + | − | + | + | − | + | − | + | − | + | − | − |

FIG. 5

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| POL | + | − | + | − | + | − | + | + | − | + | − | + | − | + | − | − | + | − | + | − | + | − | + | + | − | + | − | + | − | + |

| Frame | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|
| POL | − | − | + | − | + | − | + | − | + | + | − | + | − | + | − | + | − | − |

LIQUID CRYSTAL DISPLAY AND DRIVING METHOD THEREOF

This application claims the benefit of Korea Patent Application No. 10-2007-0141126 filed on Dec. 29, 2007, which is incorporated herein by reference for all purposes as if fully set forth herein.

BACKGROUND OF THE INVENTION

1. Field of the Invention

The present invention relates to a liquid crystal display and a method of driving the same. Exemplary embodiments are particularly suitable for preventing direct current (DC) image sticking, flicker, and nonuniform stains so as to increase the display quality of the liquid crystal display device.

2. Discussion of the Related Art

Active matrix type liquid crystal displays display a moving picture using a thin film transistor (TFT) as a switching element. The active matrix type liquid crystal displays have been implemented in televisions, as well as display devices in portable devices, such as office equipment and computers, because of the thin profile of active matrix type liquid crystal displays. Because of this thin profile feature, cathode ray tubes (CRT) are being rapidly replaced by active matrix type liquid crystal displays.

A liquid crystal display, shown in FIG. 1, switches a data voltage supplied to liquid crystal cells Clc using a thin film transistor (TFT) formed in each liquid crystal cell Clc to actively control data, thereby increasing the quality of a moving picture. In FIG. 1, the reference numeral Cst indicates a storage capacitor for holding the data voltage charged to the liquid crystal cell Clc, DL a data line to which the data voltage is supplied, and GL a scan line to which a scan voltage is supplied.

The liquid crystal display is driven in an inversion manner in which a polarity of the liquid crystal cells Clc is inverted between the neighboring liquid crystal cells Clc and the polarity is inverted every one frame period, so as to reduce direct current (DC) offset components and to reduce the degradation of a liquid crystal. If a data voltage with a predetermined polarity is dominantly supplied to the liquid crystal cell Clc for a long time, image sticking may occur. The image sticking is called direct current (DC) image sticking because the liquid crystal cells Clc are repeatedly charged to a voltage with the same polarity. DC image sticking may also occur when the data voltage is supplied to the liquid crystal display in an interlaced manner. In the interlaced manner, the data voltage is supplied to the liquid crystal cells of odd-numbered horizontal lines during odd-numbered frame periods, and the data voltage is supplied to the liquid crystal cells of even-numbered horizontal lines during even-numbered frame periods.

FIG. 2 is a waveform diagram showing an example of the data voltage supplied to the liquid crystal cell Clc in an interlaced manner. In FIG. 2, it is assumed that the liquid crystal cells Clc to which the data voltage is supplied are positioned on odd-numbered horizontal lines.

As shown in FIG. 2, a positive polarity data voltage is supplied to the liquid crystal cells Clc during odd-numbered frame periods, and a negative polarity data voltage is supplied to the liquid crystal cells Clc during even-numbered frame periods. In the interlaced manner, a high data voltage of a positive polarity is supplied to the liquid crystal cells Clc of the odd-numbered horizontal lines during only the odd-numbered frame periods. Therefore, as can be seen from the waveform diagram in a box area of FIG. 2, the positive polarity data voltage is supplied more dominantly than the negative polarity data voltage during 4 frame periods, and thus the DC image sticking appears.

FIG. 3 shows a screen of an experimental result of the DC image sticking appearing by interlaced data. If an original image shown in a left side of FIG. 3 is supplied to the liquid crystal display for a certain time in the interlaced manner, the data voltage, whose polarity changes every one frame period, noticeably changes depending on the odd-numbered frame periods and the even-numbered frame periods as shown in FIG. 2. As a result, if after the supply of the original image, the data voltage with a middle gray level, for example, 127 gray levels is supplied to all the liquid crystal cells Clc of a liquid crystal display panel, the original image is blurrily displayed on the screen as in an image shown in a right side of FIG. 3. The image shown in the right side of FIG. 3 is the DC image sticking.

As another example of the DC image sticking, if the same image is moved or scrolled at a certain speed, voltages of the same polarity are repeatedly accumulated on the liquid crystal cell Clc depending on a relationship between the size of a scrolled picture and a scrolling speed (moving speed). Hence, the DC image sticking may appear. Another example of the DC image sticking is shown in FIG. 4. FIG. 4 shows a screen of an experimental result of the DC image sticking appearing when an oblique line pattern and a character pattern are moved at a certain speed.

The display quality of the liquid crystal display is reduced by a flicker phenomenon as well as the DC image sticking. The flicker phenomenon means a luminance difference that can be periodically observed with the naked eye. Accordingly, the DC image sticking, and the flicker phenomenon have to be simultaneously prevented so as to improve the display quality of the liquid crystal display.

Nonuniform stains may appear on the display screen of the liquid crystal display. If a DC voltage of the same polarity is applied to a liquid crystal layer for a long time, impurity ions in the liquid crystal layer are separated depending on a polarity of the liquid crystal. Further, ions with different polarities are respectively accumulated on a pixel electrode and a common electrode inside the liquid crystal cells. If a DC voltage is applied to the liquid crystal layer for a long time, the amount of accumulated ions increases. Hence, an alignment layer is degraded and alignment characteristics of the liquid crystal are degraded. In other words, the application of the DC voltage to the liquid crystal display for the long time may cause the nonuniform stains on the display screen. The development of a liquid crystal material with a low permittivity or a method for improving an alignment material or an alignment method have been attempted so as to solve the nonuniform stain problem. However, it takes a long time and a heavy expense to develop a material used in the method. The use of the liquid crystal material with the low permittivity may reduce the drive characteristics of the liquid crystal. According to the experimental findings, as the amount of impurities ionized inside the liquid crystal layer increases and an acceleration factor becomes large, a time when the nonuniform stains are revealed becomes rapider. The acceleration factor may include a temperature, time, DC drive of the liquid crystal, and the like. Accordingly, the nonuniform stains may worsen at a high temperature or when the DC voltage of the same polarity is applied to the liquid crystal layer for the long time. Because the nonuniform stains appear between panels manufactured through the same manufacture line, the nonuniform stain problem cannot be solved by only the development of new material or an improvement in the process method. A method for suppressing the DC drive of the liquid crystal is effective in solving a nonuniform stain problem.

SUMMARY OF THE INVENTION

Accordingly, the present invention is directed to a liquid crystal display and driving method that substantially obviates one or more of the problems due to limitations and disadvantages of the related art.

An advantage of the present invention is to provide a liquid crystal display and a method of driving the same capable of preventing DC image sticking, flicker, and nonuniform stains so as to increase the display quality.

Additional features and advantages of the invention will be set forth in the description which follows, and in part will be apparent from the description, or may be learned by practice of the exemplary embodiments of the invention. These and other advantages of the invention will be realized and attained by the structure particularly pointed out in the written description and claims hereof as well as the appended drawings.

In one aspect, a liquid crystal display comprises a liquid crystal display panel including a plurality of data lines, a plurality of gate lines crossing the data lines, and a plurality of liquid crystal cells, a data drive circuit that inverts a polarity of a data voltage supplied to the data lines in response to a polarity control signal, a gate drive circuit that supplies a gate pulse to the gate lines, and a timing controller that generates the polarity control signal and controls the data drive circuit and the gate drive circuit, wherein the timing controller allows the polarity control signal to have a different phase in each frame and allows the liquid crystal cells to be divided into a first liquid crystal cell group charged to the data voltage of a same polarity during two frame periods and a second liquid crystal cell group charged during a current frame period to the data voltage with a polarity opposite a polarity of the data voltage charged during a previous frame period, wherein the liquid crystal cells belonging to the first liquid crystal cell group and the liquid crystal cells belonging to the second liquid crystal cell group are arranged on one screen of the liquid crystal display panel, and wherein the liquid crystal cells belonging to the first liquid crystal cell group are successively charged to the data voltage of the same polarity during three or more frame periods at intervals of predetermined time equal to or longer than two frame periods.

In another aspect, a method of driving a liquid crystal display including a liquid crystal display panel including a plurality of data lines, a plurality of gate lines crossing the data lines, and a plurality of liquid crystal cells, a data drive circuit that inverts a polarity of a data voltage supplied to the data lines in response to a polarity control signal, a gate drive circuit that supplies a gate pulse to the gate lines, and a timing controller that generates the polarity control signal and controls the data drive circuit and the gate drive circuit, the method comprises allowing the polarity control signal to have a different phase in each frame and allowing the liquid crystal cells to be divided into a first liquid crystal cell group charged to the data voltage of the same polarity during two frame periods and a second liquid crystal cell group charged during a current frame period to the data voltage with a polarity opposite a polarity of the data voltage charged during a previous frame period, and arranging the liquid crystal cells belonging to the first liquid crystal cell group and the liquid crystal cells belonging to the second liquid crystal cell group on one screen and successively charging the liquid crystal cells belonging to the first liquid crystal cell group to the data voltage of the same polarity during three or more frame periods at intervals of predetermined time equal to or longer than two frame periods.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 5 is a diagram explaining a method of driving a liquid crystal display according to an embodiment of the invention;

DETAILED DESCRIPTION OF THE ILLUSTRATED EMBODIMENTS

Reference will now be made in detail to an embodiment of the present invention, examples of which are illustrated in the accompanying drawings.

FIGS. 5 to 8 are diagrams explaining a principal in which direct current (DC) image sticking is suppressed in a liquid crystal display according to an exemplary embodiment of the invention.

The exemplary embodiments of the invention invert a polarity of a data voltage every one frame period in scrolling data moving symbols or characters at 8-pixel speed in each frame period using a polarity control signal POL for controlling a polarity of a data voltage output from a data drive circuit, and allows the polarity of the data voltage in an N-th (where N is an integer equal to or larger than 4) frame period every M (where M is larger than N) frame periods to be the same as the polarity of the data voltage in a previous frame period of the N-th frame period. For instance, as shown in FIG. 5, liquid crystal cells are charged to data voltages of symbol or character in frame periods indicated by oblique lines in FIG. 5. Polarities of the data voltages changes to "++", "−−", "++", and "−−" in octuple-numbered frame periods and previous frame periods. Accordingly, the exemplary embodiment of the invention periodically inverts a polarity of the data voltage charged to the liquid crystal cells in scrolling data moving symbols or characters at a certain speed to suppress DC image sticking appearing by the accumulation of the data voltages with the same polarity and DC drive of a liquid crystal to prevent the appearance of nonuniform stains.

Figure 1:
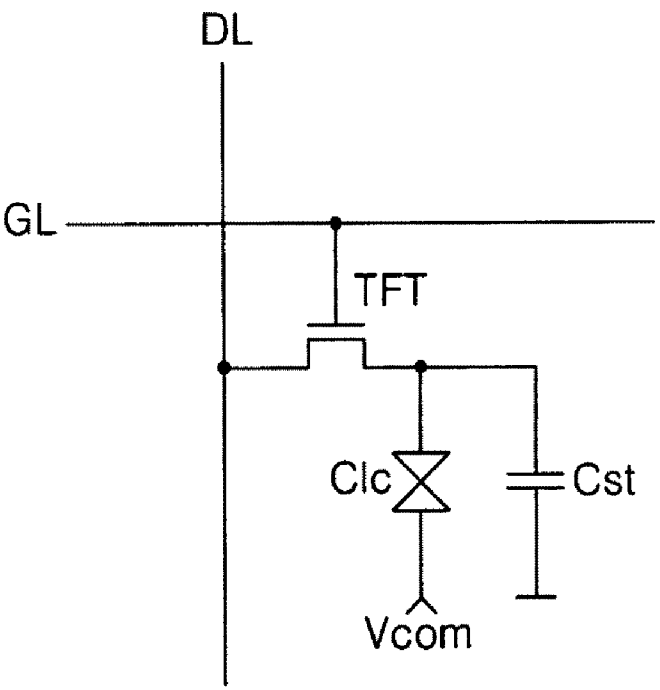
FIG. 1 Related Art
FIG. 1 is an equivalent circuit diagram showing a liquid crystal cell of a liquid crystal display.
Figure 2:
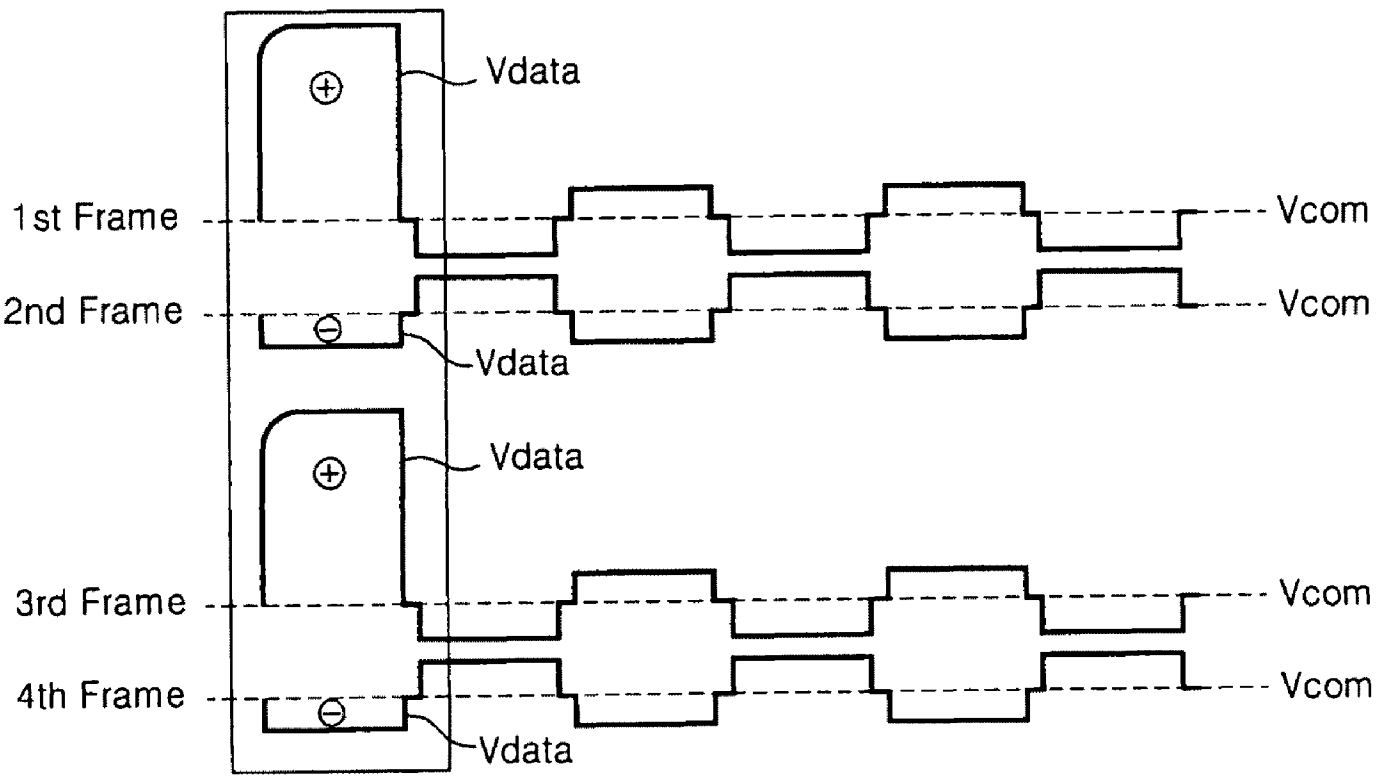
FIG. 2 Related Art
FIG. 2 is a waveform diagram showing an example of data supplied in an interlaced manner.
Figure 3:
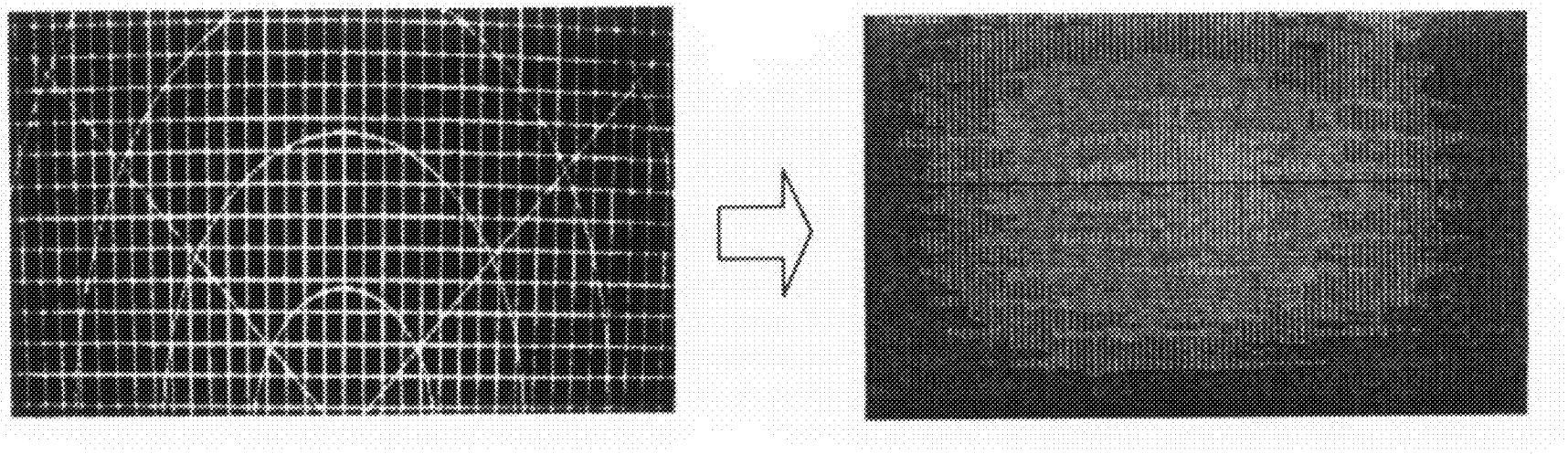
FIG. 3 Related Art
FIG. 3 shows a screen of an experimental result of DC image sticking appearing by interlaced data.
Figure 4:
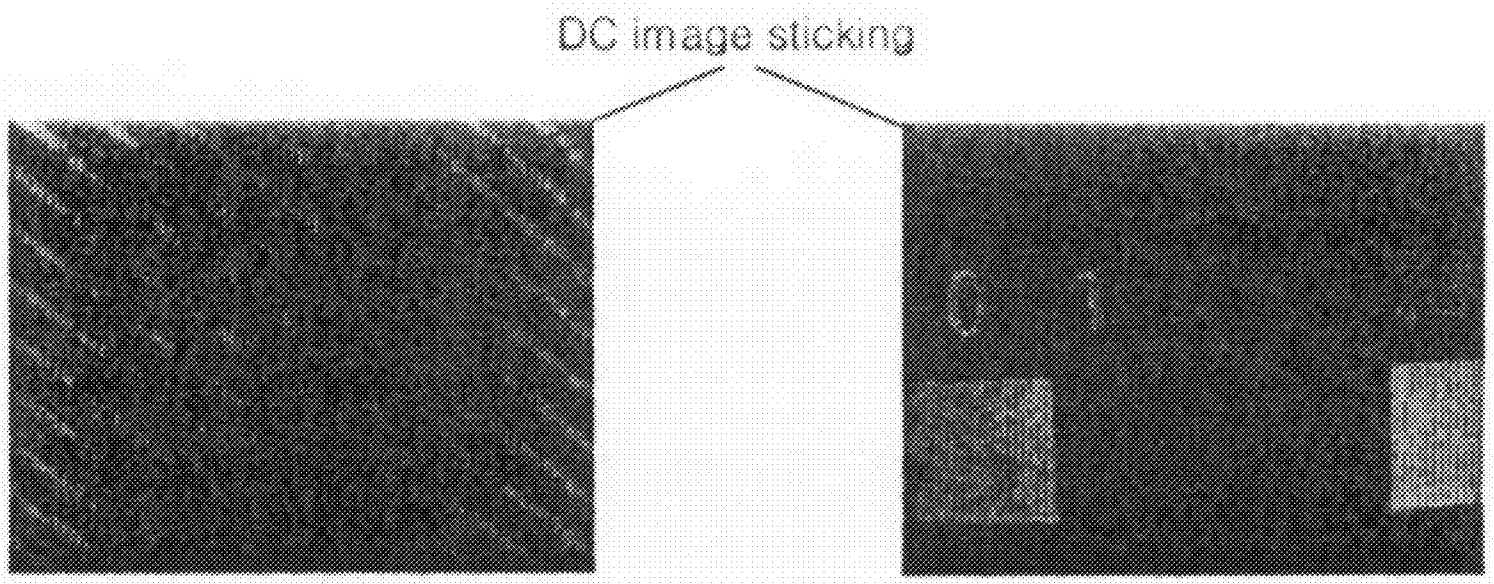
FIG. 4 Related Art
FIG. 4 shows a screen of an experimental result of DC image sticking appearing by scrolling data.
Figure 6:
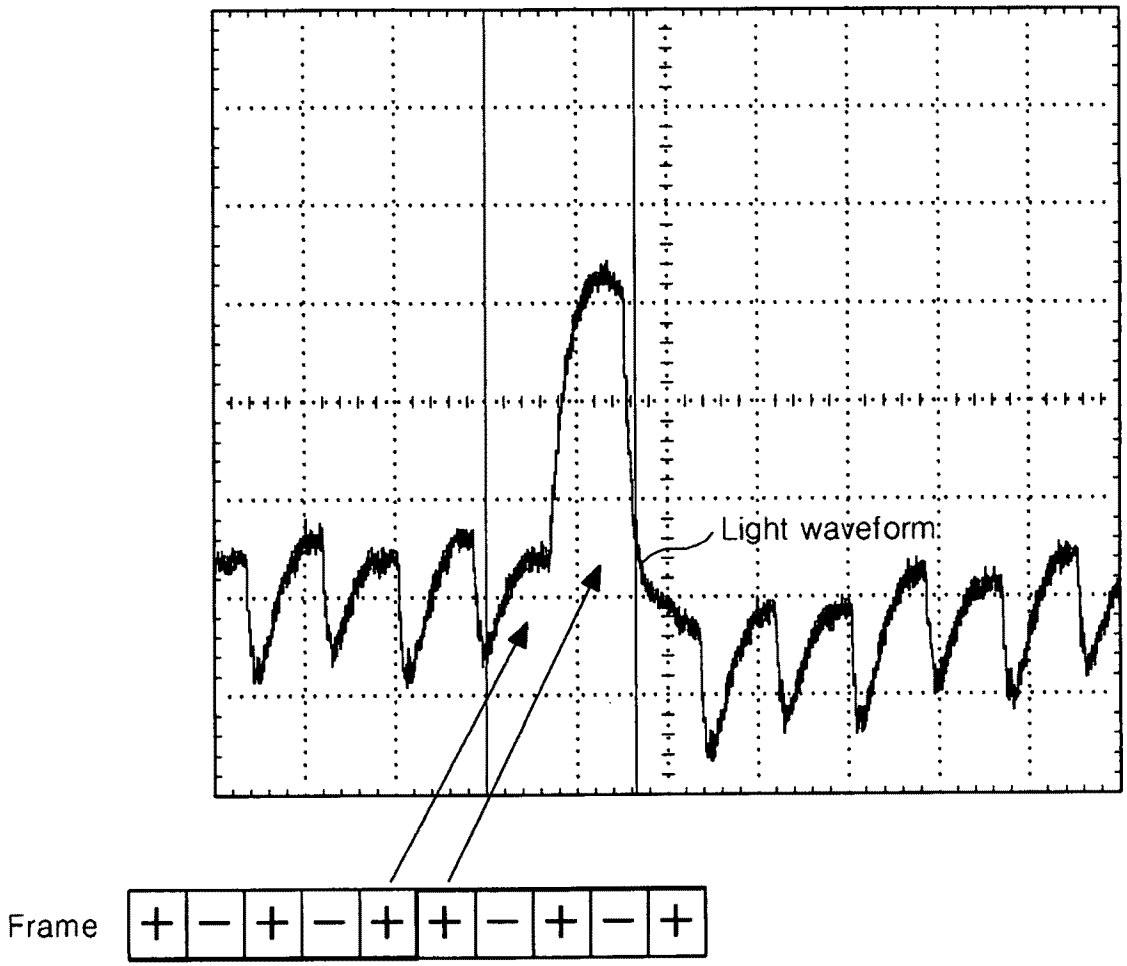
FIG. 6 shows an experimental result of a flicker phenomenon appearing in an Nth frame period.

As can be seen from a light waveform of FIG. 6, which is an output waveform diagram of a photosensor on a liquid crystal display panel, because the liquid crystal cells are repeatedly charged to a data voltage with the same polarity as the data voltage in the previous frame period of the N-th frame period during the N-th frame period, DC image sticking can be prevented. However, the amount of light may increase by the excessive accumulation of the data voltages charged to the liquid crystal cells during the N-th frame period. An observer may see a flicker phenomenon, in which a luminance increases every N frame periods because of the accumulation of the data voltages with the same polarity. Accordingly, the exemplary embodiment of the invention, as shown in FIG. 7, shifts the polarity control signal for controlling the polarity of the data voltage between frame periods and allows a data drive frequency of a first liquid crystal cell group to be different from a data drive frequency of a second liquid crystal cell group.

Figure 7:
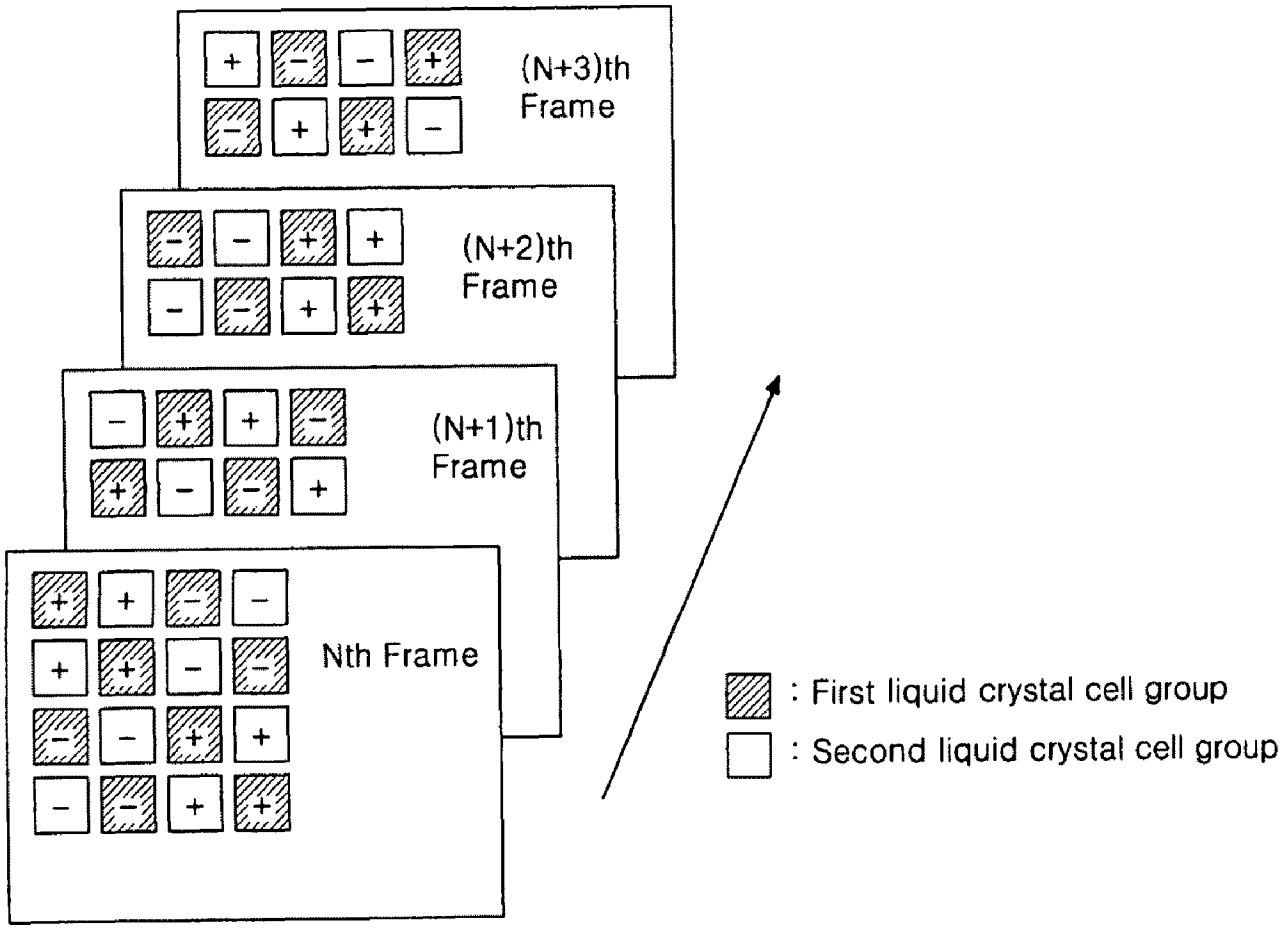
FIG. 7 shows an example of a method for controlling data drive frequencies of neighboring liquid crystal cells to be different from each other.

As shown in FIG. 7, an exemplary embodiment of the invention shifts a phase of the polarity control signal and allows polarity inverting time points of the data voltages charged to the first and second liquid crystal cell groups to be different from each other. In a liquid crystal display according to an exemplary embodiment of the invention, liquid crystal cells belonging to the first liquid crystal cell group, to which the data voltage with the same polarity is supplied during two frame periods, are adjacent to liquid crystal cells belonging to the second liquid crystal cell group to which the data voltages with a different polarity are supplied during two frame periods. A location of the liquid crystal cells belonging to the first liquid crystal cell group and a location of the liquid crystal cells belonging to the second liquid crystal cell group may vary every one frame period.

A method of driving the liquid crystal display according to an exemplary embodiment of the invention supplies a data voltage having the same polarity to the liquid crystal cells during two (2) or more frame periods to prevent DC image sticking and nonuniform stains, and also inverts the polarity of the data voltage charged to the first liquid crystal cell group during two (2) frame periods to prevent flicker.

Figure 8:
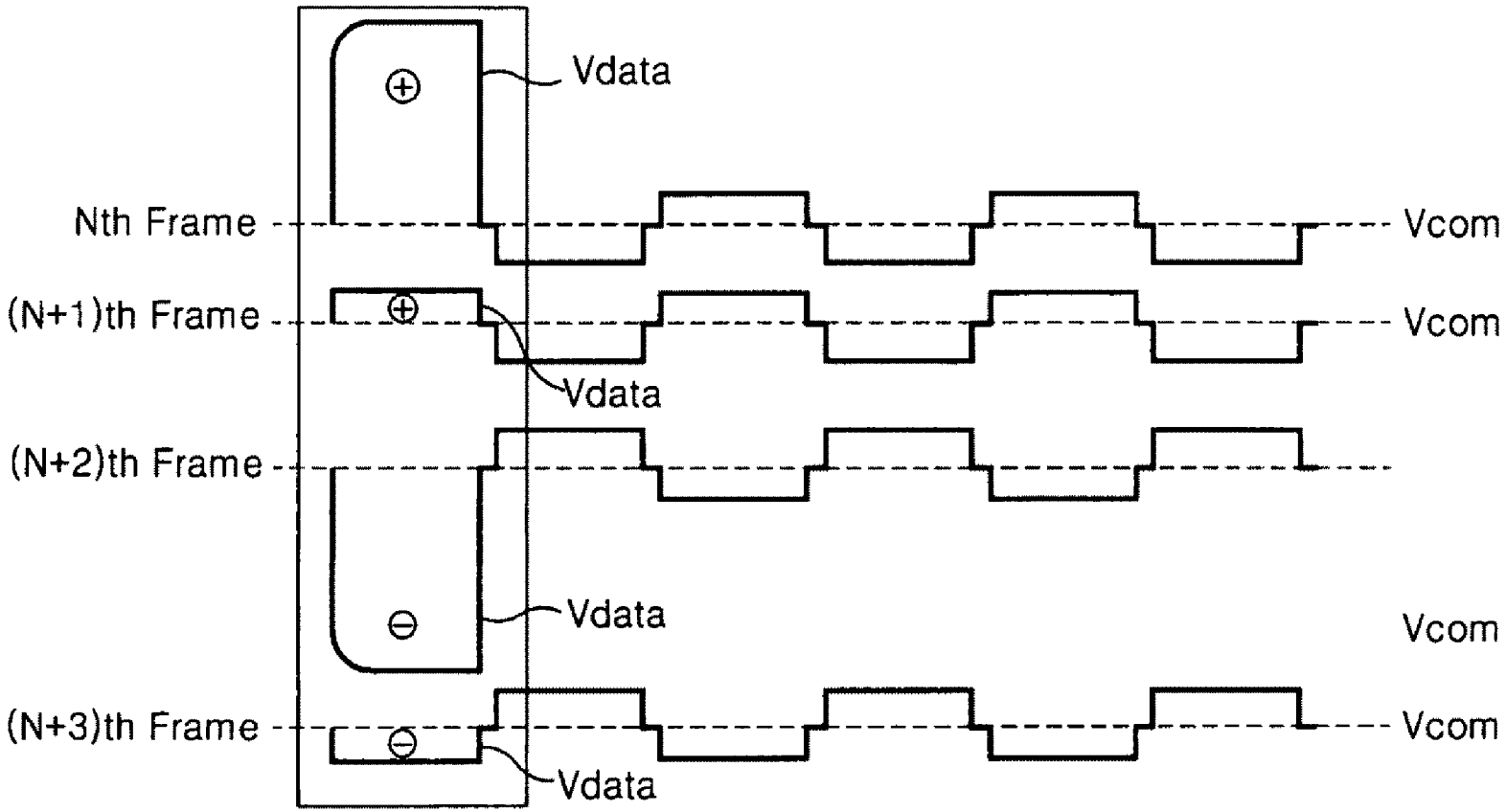
FIG. 8 is a waveform diagram showing the suppression effect of DC drive of a liquid crystal when interlaced data is supplied.

As shown in FIG. 8, when the liquid crystal display receives interlaced data in which a high data voltage is supplied to the liquid crystal cell during odd-numbered frame periods, the exemplary embodiment of the invention supplies the data voltage, whose polarity is inverted every two (2) frame periods, to the liquid crystal cells belonging to the first and second liquid crystal cell groups. Hence, as can be seen from a waveform in the boxed area of FIG. 8, a positive polarity data voltage supplied to the liquid crystal cell during Nth and (N+1)th frame periods and a negative polarity data voltage supplied to the same liquid crystal cell during (N+2)th and (N+3)th frame periods are offset from each other. Thus, the data voltage with the positive polarity or the negative polarity is not dominantly accumulated in the liquid crystal cell. Accordingly, when the liquid crystal display according to the exemplary embodiment of the invention receives the interlaced data, the DC drive of a liquid crystal is suppressed. Hence, DC image sticking and nonuniform stains can be prevented.

Further, if data voltage having the same polarity is applied to all the liquid crystal cells, as shown in FIG. 6, is inverted every 2 frame periods, a flicker may appear every 2 frame periods. If a period where the luminance changes shortens, an observer cannot see the flicker. Accordingly, the method of driving the liquid crystal display according to the exemplary embodiment of the invention inverts a polarity of the data voltage supplied to another liquid crystal cells existing around the liquid crystal cells, that are charged to the data voltage of the same polarity during 2 frame periods, every one frame period to increase a space frequency of the display screen. Hence, the observer cannot see the flicker.

FIGS. 9 to 12 show the liquid crystal display according to the exemplary embodiment of the invention.

Figure 9:
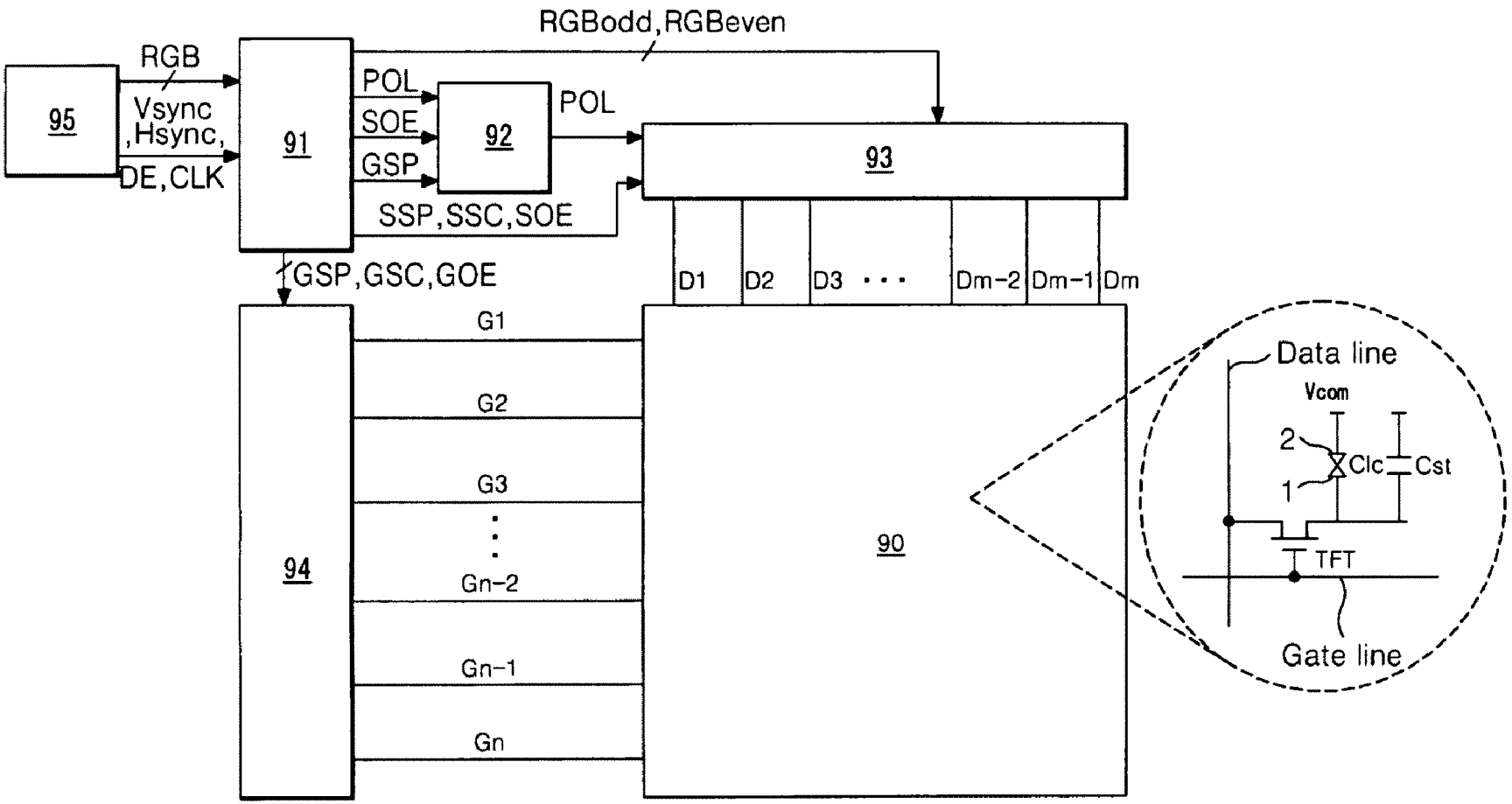
FIG. 9 is a block diagram of the liquid crystal display according to the exemplary embodiment of the invention.

As shown in FIG. 9, the liquid crystal display according to an embodiment of the invention includes a liquid crystal display panel 90, a timing controller 91, a logic circuit 92, a data drive circuit 93, and a gate drive circuit 94.

The liquid crystal display panel 90 includes an upper glass substrate, a lower glass substrate, and a liquid crystal layer between the upper and lower glass substrates. The lower glass substrate of the liquid crystal display panel 90 includes m data lines D1 to Dm and n gate lines G1 to Gn that cross each other. As such, the liquid crystal display panel 90 includes m×n liquid crystal cells Clc arranged in a matrix array at each crossing of the m data lines D1 to Dm and the n gate lines G1 to Gn. The liquid crystal cells Clc include a first liquid crystal cell group and a second liquid crystal cell group. The lower glass substrate further includes a thin film transistor TFT, a pixel electrode 1 of the liquid crystal cell Clc connected to the thin film transistor TFT, and a storage capacitor Cst, and the like.

The upper glass substrate of the liquid crystal display panel 90 includes a black matrix, a color filter, and a common electrode 2. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizers having optical axes that cross at a right angle are attached respectively to the upper and lower glass substrates. Alignment layers for setting a pre-tilt angle of the liquid crystal in an interface contacting the liquid crystal are respectively formed on the upper and lower glass substrates.

The timing controller 91 receives timing signals, such as vertical and horizontal sync signals Vsync and Hsync, a data enable signal DE, and a clock signal CLK which are input from a video source 95, and produces timing control signals for controlling operation timing of the logic circuit 92, the data drive circuit 93, and the gate drive circuit 94. The video source 95 includes, for example, a scaler mounted on a system board. The video source 95 converts video data input from an external video device or video data of a broadcasting signal received as a radio signal into digital data. Then, the video source 95 transmits the digital data to the timing controller 91 and at the same time, transmits the timing signals to the timing controller 91. The timing control signals produced by the timing controller 91 include, for example, a gate start pulse GSP, a gate shift clock signal GSC, a gate output enable signal GOE, a source start pulse SSP, a source sampling clock signal SSC, a source output enable signal SOE, and a polarity control signal POL. The gate start pulse GSP indicates a scan start line of a scan operation in 1 vertical period in which one screen is displayed. The gate shift clock signal GSC is a timing control signal that is input to a shift resistor installed in the gate drive circuit 94 to sequentially shift the gate start pulse GSP, and has a pulse width corresponding to a turned-on period of the thin film transistor TFT. The gate output enable signal GOE directs an output of the gate drive circuit 94. The source start pulse SSP indicates a start pixel in 1 horizontal line to which data will be displayed. The source sampling clock signal SSC directs a data latch operation to the data drive circuit 93 based on a rising or falling edge. The source output enable signal SOE directs an output of the data drive circuit 93. The polarity control signal POL indicates a polarity of the data voltage that will be supplied to the liquid crystal cells Clc of the liquid crystal display panel 90. The polarity control signal POL may include 1 dot inversion polarity control signal whose logic state is inverted every one horizontal period or a 2 dot inversion polarity control signal whose logic state is inverted every 2 horizontal periods. The exemplary embodiment of the invention will be described below with the assumption that the polarity control signal POL includes the 2 dot inversion polarity control signal whose logic state is inverted every 2 horizontal periods.

In an embodiment, the timing controller 91 divides digital video data RGB into odd-numbered pixel data RGBodd and even-numbered pixel data RGBeven so as to lower a transmission frequency of the digital video data RGB, and then supplies the data RGBodd and RGBeven to the data drive circuit 93 through 6 data buses.

The logic circuit 92 receives the gate start pulse GSP and the source output enable signal SOE to sequentially output polarity control signals having different phases during K frame periods, where K is a positive integer smaller than N. Then, the logic circuit 92 repeatedly performs the above-described output operation for a predetermined period of time. After the logic circuit 92 changes output order of the polarity control signals from the Nth frame period, the logic circuit 92 repeatedly performs the changed output operation for a predetermined period of time. The logic circuit 92 may be built in the timing controller 91.

The data drive circuit 93 latches the digital video data RGBodd and RGBeven under the control of the timing controller 91, and then converts the digital video data RGBodd and RGBeven into analog positive and negative gamma compensation voltages in response to the polarity control signal POL output from the logic circuit 92. Hence, the data drive circuit 93 may generate analog positive and negative data voltages and supplies the analog positive and negative data voltages to the data lines D1 to Dm. The data drive circuit 93 inverts a polarity of the data voltage in response to the polarity control signal POL output from the logic circuit 92.

The gate drive circuit 94 includes, for example, a shift resistor, a level shifter for shifting an output signal of the shift resistor to a swing width suitable for a TFT drive of the liquid crystal cells Clc, and an output buffer. The gate drive circuit 94 may also include a plurality of gate drive integrated circuits (ICs) and sequentially outputs gate pulses (or scan pulses) each having a width of about 1 horizontal period.

Figure 10:
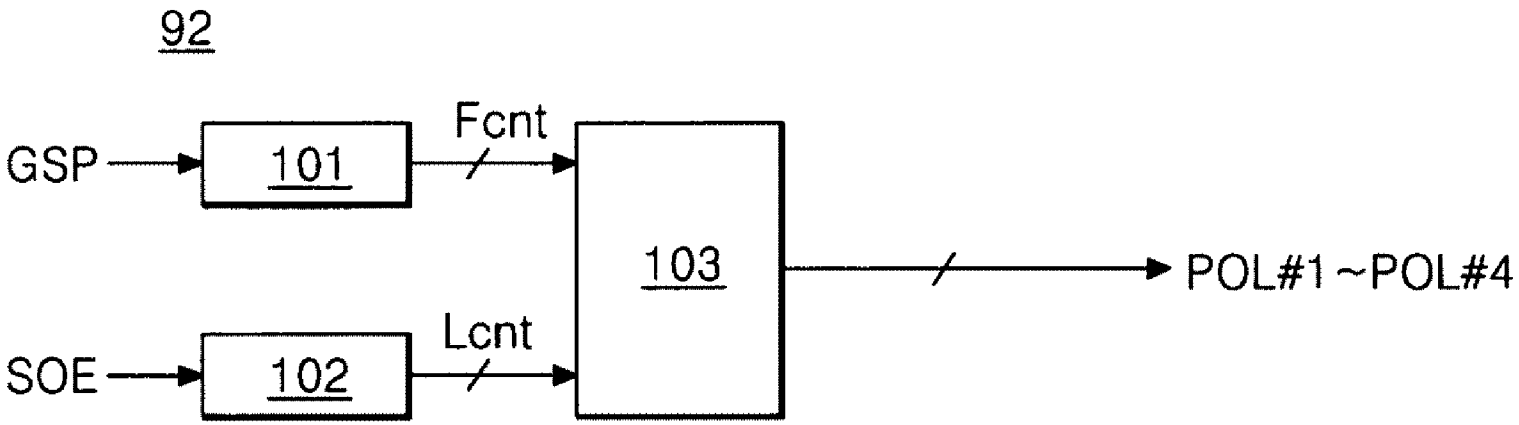
FIG. 10 is a block diagram showing in detail a logic circuit.
Figure 11:
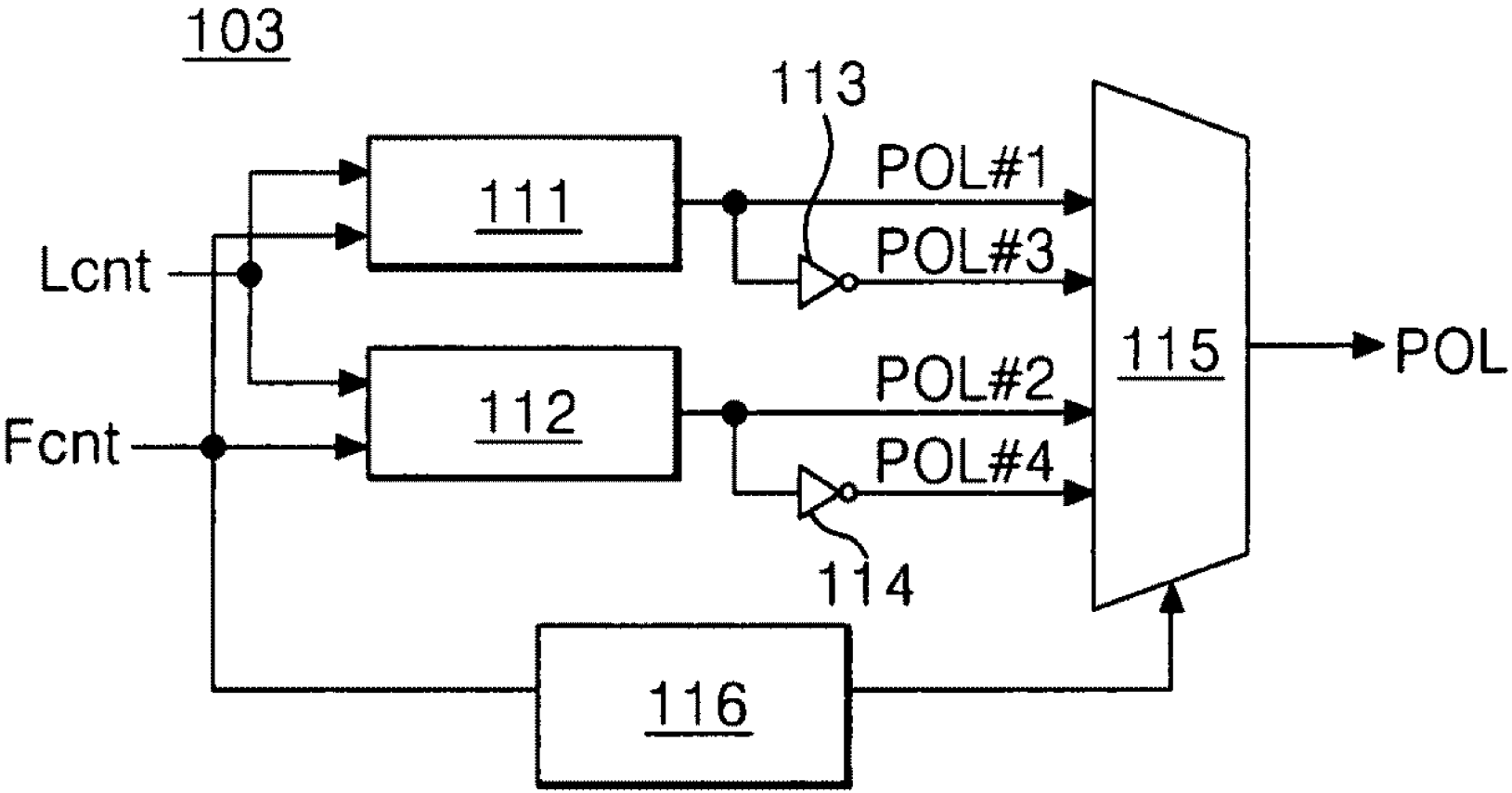
FIG. 11 is a block diagram showing in detail a polarity control signal generation circuit.

FIGS. 10 and 11 are circuit diagrams illustrating the logic circuit 92 and the POL generation circuit 103 in detail.

As shown in FIG. 10, the logic circuit 92 includes, for example, a frame counter 101, a line counter 102, and a polarity control signal (POL) generation circuit 103.

The frame counter 101 outputs frame count information Fcnt instructing the number of frames in an image to be displayed on the liquid crystal display panel 90 in response to the gate start pulse GSP, that is generated once during one frame period as soon as one frame period starts.

The line counter 102 outputs line count information Lcnt instructing a row (or horizontal line) of data to be displayed on the liquid crystal display panel 90 in response to the source output enable signal SOE instructing an output time point of the data voltage from the logic circuit 92 every one horizontal period.

The POL generation circuit 103, as shown in FIG. 11, sequentially, for example, generates, for example, first to fourth polarity control signals POL#1 to POL#4 using a first POL generation circuit 111, a second POL generation circuit 112, first and second inverters 113 and 114, a multiplexer 115, and a frame controller 116.

The first POL generation circuit 111 generates the first polarity control signal POL#1, whose logic state is inverted depending on the frame count information Fcnt and the line count information Lcnt. The first polarity control signal POL#1 is inverted every 2 horizontal periods so that the liquid crystal cells arranged parallel to each other in a vertical direction are charged to the data voltage, whose polarity is inverted in a vertical 2-dot inversion manner. Every time a predetermined time, for example, 0.5 or 1 second elapses, the first POL generation circuit 111 inverts a phase of the first polarity control signal POL#1. The first inverter 113 inverts the first polarity control signal POL#1 to generate the third polarity control signal POL#3 whose phase is opposite to the phase of the first polarity control signal POL#1.

The second POL generation circuit 112 generates a second polarity control signal POL#2, whose logic state is inverted depending on the frame count information Fcnt and the line count information Lcnt. A phase of the second polarity control signal POL#2 is shifted from the phase of the first polarity control signal POL#1 by about 1 horizontal period. For each predetermined time, for example, 0.5 or 1 second elapses, the second POL generation circuit 112 inverts the phase of the second polarity control signal POL#2. The second inverter 114 inverts the second polarity control signal POL#2 to generate the fourth polarity control signal POL#4 whose the phase is opposite to the phase of the second polarity control signal POL#2.

The frame controller 116 receives the frame count information Fcnt and the line count information Lcnt to control the multiplexer 115 so that the polarity control signal corresponding to each frame can be output as shown in FIGS. 12 to 19.

FIGS. 12 to 15 show a first embodiment of the method of driving the liquid crystal display.

Figure 12:
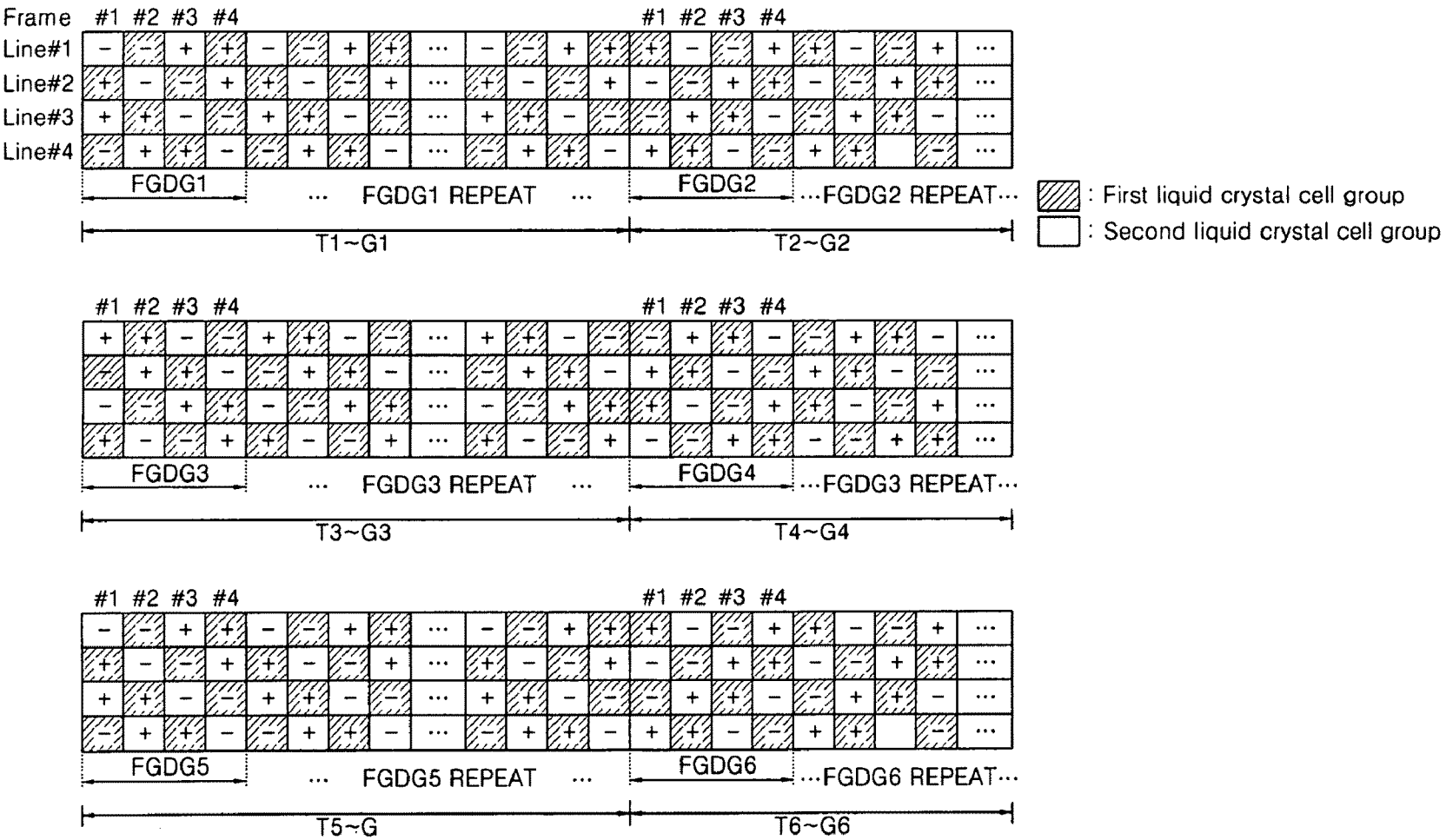
FIG. 12 shows a first embodiment of a method of driving a liquid crystal display and shows changes in a polarity of a data voltage charged to the liquid crystal cells.

As shown in FIG. 12, the liquid crystal cells include the liquid crystal cells belonging to a first liquid crystal cell group and the liquid crystal cells belonging to a second liquid crystal cell group which are alternately arranged. "+" indicates the liquid crystal cells charged to the positive polarity data voltage, and "−" indicates the liquid crystal cells charged to the negative polarity data voltage. A transverse axis indicates a frame period, namely, time, and a longitudinal axis indicates lines, namely, the display surface.

Figure 13:
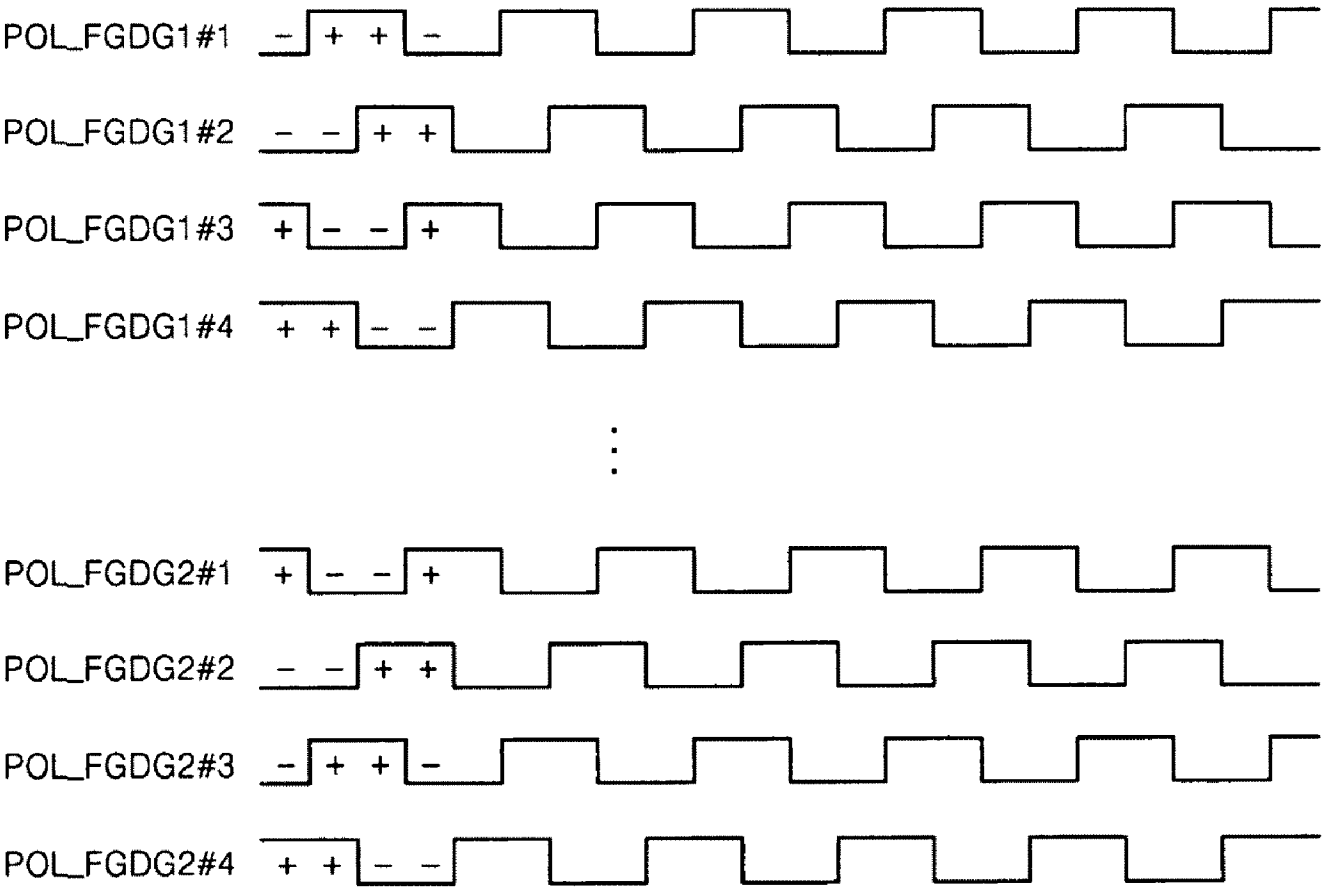
FIGS. 13 to 15 are waveform diagrams showing a polarity control signal for controlling the polarity of the data voltage shown in FIG. 12.
Figure 14:
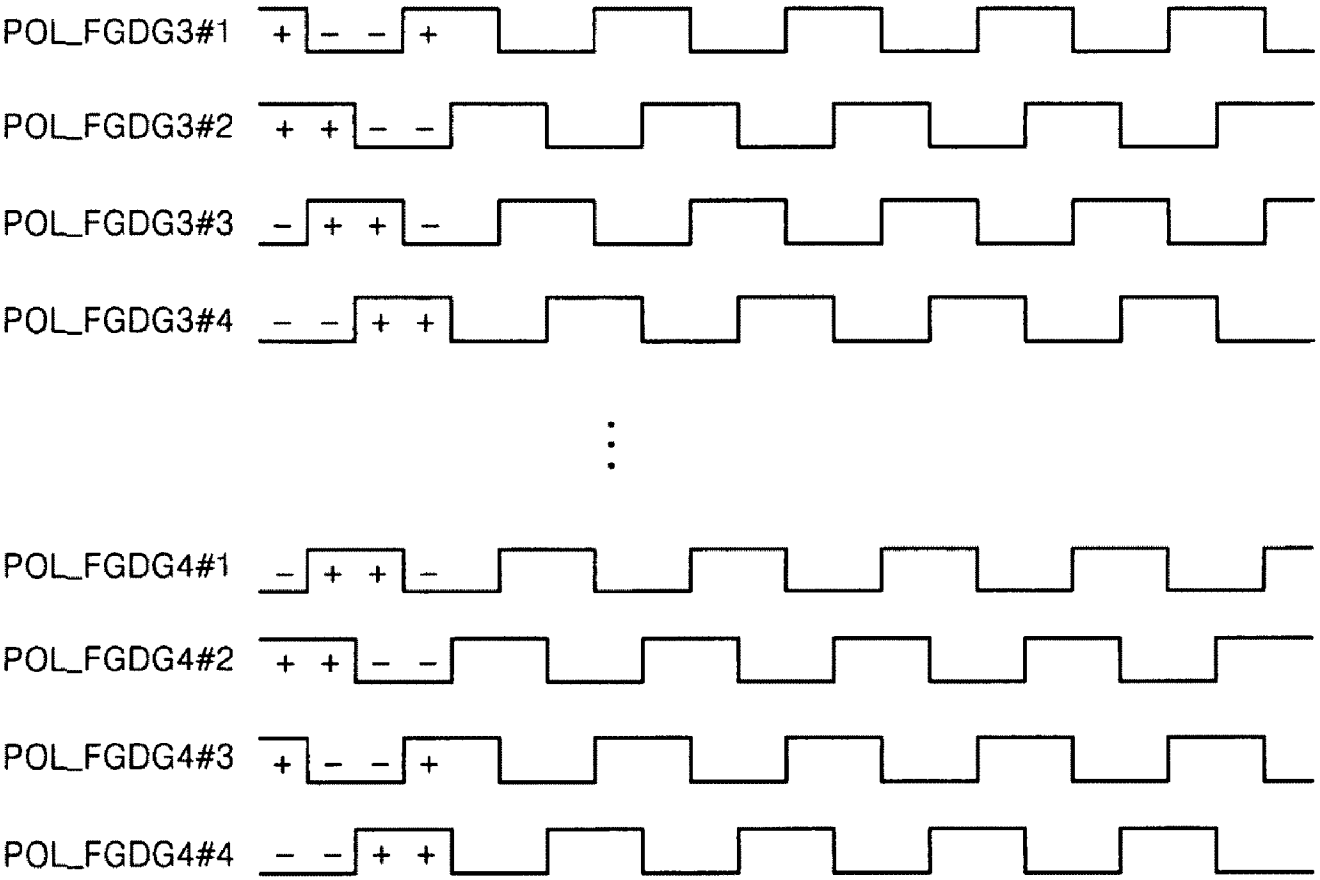
Figure 15:
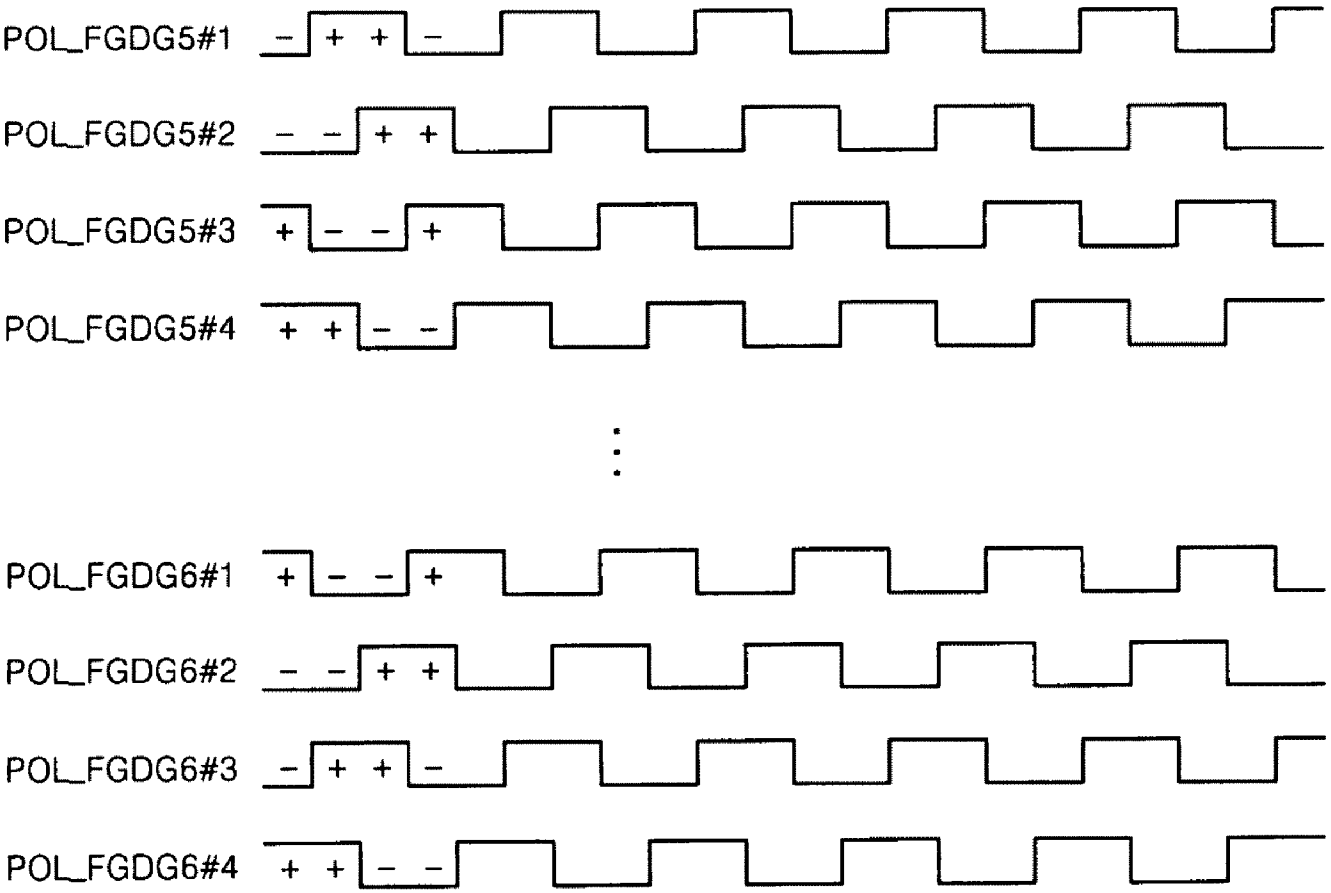

The logic circuit 92, as shown in FIGS. 13 to 15, sequentially outputs polarity control signals POL_FGDG1#1 to POL_FGDG1#4 belonging to a first group, and repeatedly performs an output operation of the polarity control signals POL_FGDG1#1 to POL_FGDG1#4 belonging to the first group during a first period T1_G1. During a second period T1_G2 following the first period T1_G1, the logic circuit 92 sequentially outputs polarity control signals POL_FGDG2#1 to POL_FGDG2#4 belonging to a second group, and repeatedly performs an output operation of the polarity control signals POL_FGDG2#1 to POL_FGDG2#4 belonging to the second group. During a third period T1_G3 following the second period T1_G2, the logic circuit 92 sequentially outputs polarity control signals POL_FGDG3#1 to POL_FGDG3#4 belonging to a third group, and repeatedly performs an output operation of the polarity control signals POL_FGDG3#1 to POL_FGDG3#4 belonging to the third group. During a fourth period T1_G4 following the third period T1_G3, the logic circuit 92 sequentially outputs polarity control signals POL_FGDG4#1 to POL_FGDG4#4 belonging to a fourth group, and repeatedly performs an output operation of the polarity control signals POL_FGDG4#1 to POL_FGDG4#4 belonging to the fourth group. The data drive circuit 93 inverts a polarity of the data voltage to be supplied to the data lines D1 to Dm of the liquid crystal display panel 90 in response to the polarity control signal POL output from the logic circuit 92.

A location of the liquid crystal cells belonging to the first liquid crystal cell group and a location of the liquid crystal cells belonging to the second liquid crystal cell group are reversed in each frame due to the polarity control signals POL_FGDG4#1 to POL_FGDG1#4 of the first group for a predetermined period of time.

After the predetermined period of time elapses, when the first polarity control signal POL_FGDG2#1 of the second group is generated during the Nth frame period, the liquid crystal cells of odd-numbered rows are charged to the data voltage with the same polarity as the data voltage charged during previous two frame periods of the Nth frame period.

After the predetermined period of time elapses, when the polarity control signals POL_FGDG3#1 to POL_FGDG3#4 of the third group are generated, a location of the liquid crystal cells belonging to the first liquid crystal cell group and a location of the liquid crystal cells belonging to the second liquid crystal cell group are reversed in each frame.

After the predetermined period of time elapses, when the first polarity control signal POL_FGDG4#1 of the fourth group is generated during a 2Nth frame period, the liquid crystal cells of the odd-numbered rows are charged to the data voltage with the same polarity as the data voltage charged during previous two frame periods of the 2Nth frame period. Further, the liquid crystal cells of the odd-numbered rows are charged to the data voltage with the same polarity as the data voltage, that is charged during the Nth frame period, during 3 frame periods ranging from (2N−2)th to 2N frame periods.

After the predetermined period of time elapses, a location of the liquid crystal cells belonging to the first liquid crystal cell group and a location of the liquid crystal cells belonging to the second liquid crystal cell group are reversed in each frame due to polarity control signals POL_FGDG5#1 to POL_FGDG5#4 belonging to a fifth group, as illustrated in FIG. 15.

After the predetermined period of time elapses, when a first polarity control signal POL_FGDG6#1 belonging to a sixth group is generated during a 3Nth frame period, the liquid crystal cells of the odd-numbered rows are charged to the data voltage with the same polarity as the data voltage charged during previous two frame periods of the 3Nth frame period. Further, the liquid crystal cells of the odd-numbered rows are charged to the data voltage with a polarity opposite the polarity of the data voltage, that is charged during the (2N−2)th to 2N frame periods, during 3 frame periods ranging from (3N−2)th to 3N frame periods, as illustrated in FIG. 15.

To generate the polarity control signals POL shown in FIGS. 13 to 15, the first POL generation circuit 111 generates the first polarity control signal POL_FGDG1#1 of the first group whose logic state is inverted in a order of low, high, high, and low logic states until the liquid crystal cells of first to fourth horizontal lines Line#1 to Line#4 are scanned during the generation of the polarity control signals POL_FGDG1#1 to POL_FGDG1#4 of the first group. Sequentially, after a predetermined period of time elapses, the first POL generation circuit 111 generates the first polarity control signal POL_FGDG2#1 of the second group having a phase opposite a phase of the first polarity control signal POL_FGDG1#1 of the first group. After a predetermined period of time elapses, the first POL generation circuit 111 generates the first polarity control signal POL_FGDG3#1 of the third group having a phase opposite a phase of the first polarity control signal POL_FGDG1#1 of the first group. Sequentially, after a predetermined period of time elapses again, the first POL generation circuit 111 generates the first polarity control signal POL_FGDG4#1 of the fourth group having a phase opposite a phase of the first polarity control signal POL_FGDG2#1 of the second group. Sequentially, after a predetermined period of time elapses, the first POL generation circuit 111 generates the first polarity control signal POL_FGDG5#1 of the fifth group having a phase opposite a phase of the first polarity control signal POL_FGDG4#1 of the fourth group. Sequentially, after a predetermined period of time elapses again, the first POL generation circuit 111 generates the first polarity control signal POL_FGDG6#1 of the sixth group having a phase opposite a phase of the first polarity control signal POL_FGDG5#1 of the fifth group.

The second POL generation circuit 112 generates the second polarity control signal POL_FGDG1#2 of the first group whose a logic state is inverted in order of low, low, high, and high logic states until the liquid crystal cells of the first to fourth horizontal lines Line#1 to Line#4 are scanned during the generation of the polarity control signals POL_FGDG1#L to POL_FGDG1#4 of the first group and the generation of the polarity control signals POL_FGDG2#1 to POL_FGDG2#4 of the second group. A phase of the second polarity control signal POL_FGDG1#2 of the first group is shifted from the phases of the first polarity control signals POL_FGDG1#L and POL_FGDG2#1 of the first and second groups by 1 horizontal period. Sequentially, the second POL generation circuit 112 generates the second polarity control signals POL_FGDG3#2 and POL_FGDG4#2 of the third and fourth groups having phases opposite the phases of the second polarity control signals POL_FGDG1#2 and POL_FGDG2#2 of the first and second groups. Then, the second POL generation circuit 112 generates the second polarity control signals POL_FGDG5#2 and POL_FGDG6#2 of the fifth and sixth groups having phases opposite the phases of the second polarity control signals POL_FGDG3#2 and POL_FGDG4#2 of the third and fourth groups.

As can be seen from FIGS. 13 to 15, the phases of the polarity control signals POL_FGDG1#1 to POL_FGDG1#4 of the first group are the same as the phases of the polarity control signals POL_FGDG5#1 to POL_FGDG5#4 of the fifth group, respectively. Further, the phases of the polarity control signals POL_FGDG2#1 to POL_FGDG2#4 of the second group are the same as the phases of the polarity control signals POL_FGDG6#1 to POL_FGDG6#4 of the sixth group, respectively.

The method of driving the liquid crystal display according to the first implementation improves the DC image sticking and the flicker as shown in FIGS. 5 to 8 using the polarity control signals of the first to sixth groups shown in FIG. 12, and also can prevent nonuniform stains by suppressing the DC drive of the liquid crystal.

Figure 16:
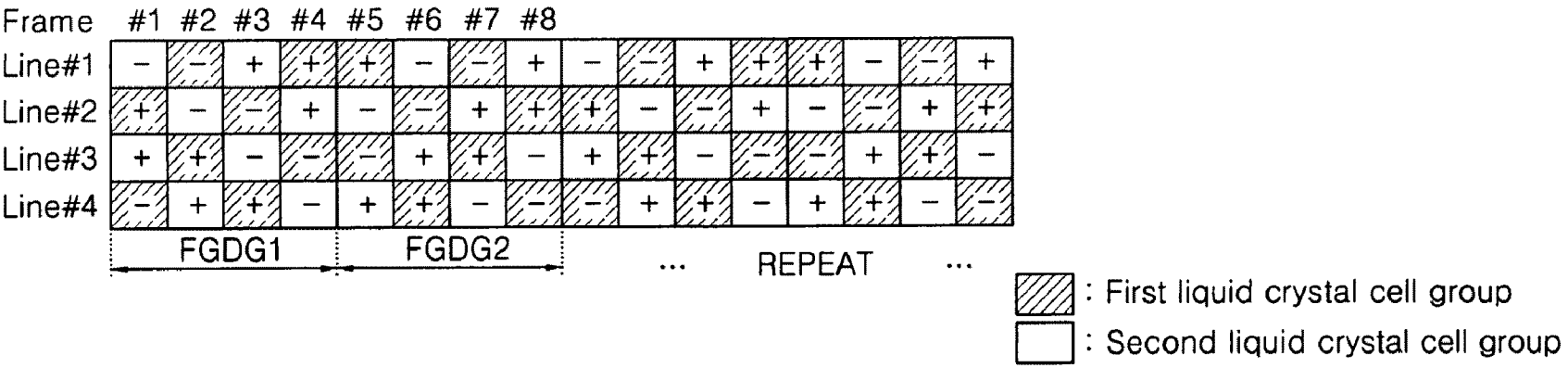
FIG. 16 illustrates a second embodiment of the method of driving the liquid crystal display and shows changes in a polarity of a data voltage charged to the liquid crystal cells.
Figure 17:
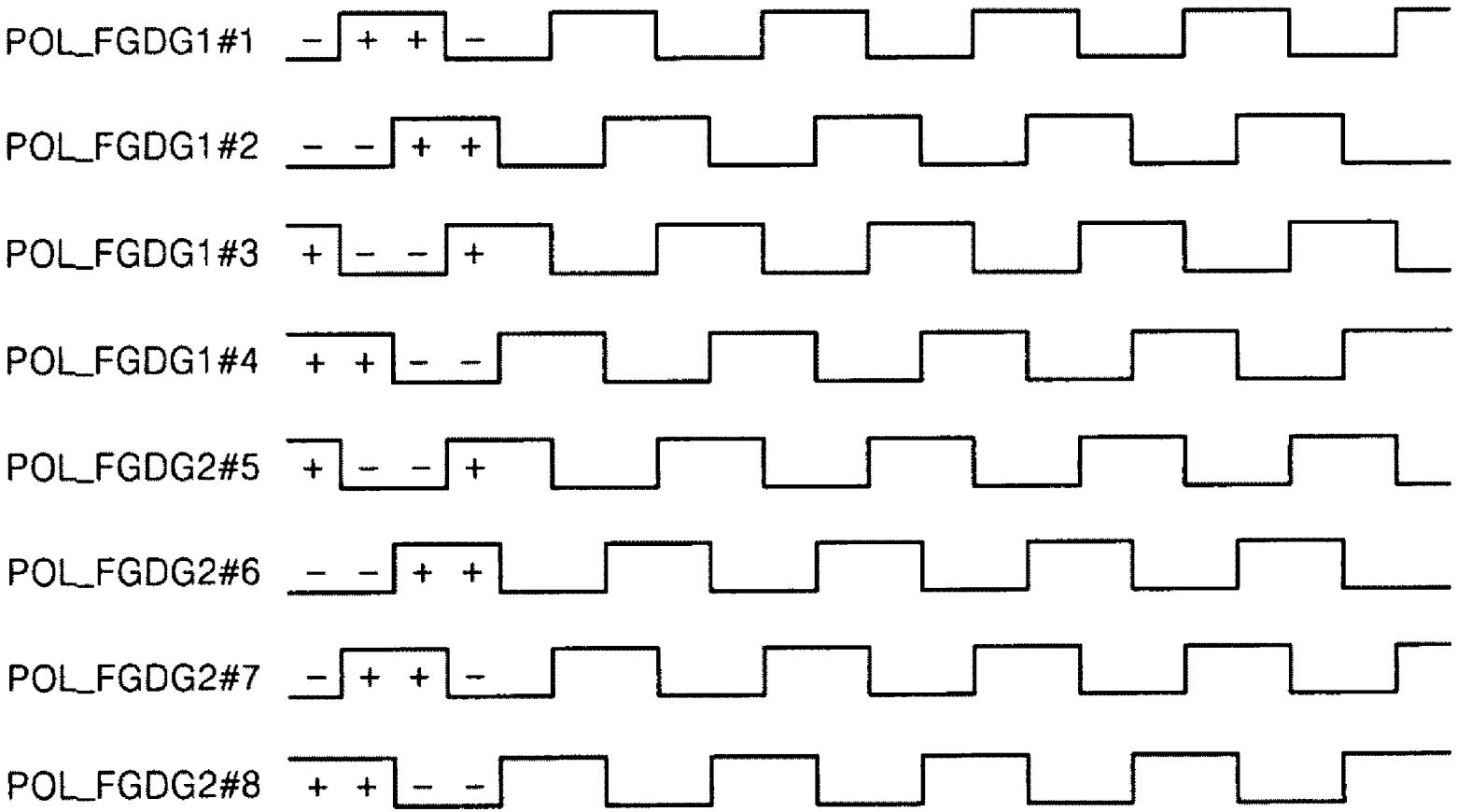
FIG. 17 is a waveform diagram showing a polarity control signal for controlling the polarity of the data voltage shown in FIG. 16.

FIGS. 16 and 17 show a second embodiment of the method of driving the liquid crystal display.

As shown in FIGS. 16 and 17, the liquid crystal cells include the liquid crystal cells belonging to a first liquid crystal cell group and the liquid crystal cells belonging to a second liquid crystal cell group which are alternately arranged. "+" indicates the liquid crystal cells charged to the positive polarity data voltage, and "−" indicates the liquid crystal cells charged to the negative polarity data voltage. A transverse axis indicates a frame period, namely, time, and a longitudinal axis indicates lines, namely, the display surface.

After the logic circuit 92 sequentially outputs polarity control signals POL_FGDG1#1 to POL_FGDG1#4 belonging to a first group during 4 frame periods, the logic circuit 92 sequentially outputs polarity control signals POL_FGDG2#5 to POL_FGDG2#8 belonging to a second group during 4 frame periods. In other words, the logic circuit 92 alternately outputs the polarity control signals POL_FGDG1#5 to POL_FGDG1#8 of the first group and the polarity control signals POL_FGDG2#1 to POL_FGDG2#4 of the second group every 4 frame periods. Hence, a location of the first liquid crystal cell group and a location of the second liquid crystal cell group change in each of second and third frame periods #2 and #3, during which a polarity of the data voltage is controlled by the second and third polarity control signals POL_FGDG1#2 and POL_FGDG1#3 of the first group, and sixth and seventh frame periods #6 and #7, during which a polarity of the data voltage is controlled by the second and third polarity control signals POL_FGDG2#6 and POL_FGDG2#7 of the second group, and thus the DC image sticking and the flicker can be prevented by suppressing the DC drive of the liquid crystal as shown in FIGS. 7 and 8. The liquid crystal cells of odd-numbered rows are charged to the data voltage with the same polarity during the third frame period during which a polarity of the data voltage is controlled by the third and fourth polarity control signals POL_FGDG1#3 and POL_FGDG1#4 of the first group and the first polarity control signal POL_FGDG2#1 of the second group. The liquid crystal cells of even-numbered rows are charged to the data voltage with the same polarity during the third frame period during which a polarity of the data voltage is controlled by the third and fourth polarity control signals POL_FGDG2#3 and POL_FGDG2#4 of the second group and the first polarity control signal POL_FGDG1#1 of the first group. Hence, the nonuniform stains can be prevented by suppressing the DC drive of the liquid crystal as shown in FIGS. 5 and 6.

To generate the polarity control signals POL shown in FIG. 17, the first POL generation circuit 111 generates the first polarity control signal POL_FGDG1#1 of the first group whose logic state is inverted in an order of low, high, high, and low logic states until the liquid crystal cells of first to fourth horizontal lines Line#1 to Line#4 are scanned. Sequentially, after 4 frame periods elapse, the first POL generation circuit 111 generates the first polarity control signal POL_FGDG2#5 of the second group with a phase opposite a phase of the first polarity control signal POL_FGDG1#1 of the first group during a fifth frame period.

The second POL generation circuit 112 generates the second polarity control signal POL_FGDG1#2 of the first group whose logic state is inverted in an order of low, low, high, and high logic states until the liquid crystal cells of the first to fourth horizontal lines Line#1 to Line#4 are scanned. The second polarity control signal POL_FGDG1#2 of the first group has a phase shifted from the phases of the first polarity control signals POL_FGDG1#1 and POL_FGDG2#1 of the first and second groups by 1 horizontal period.

Figure 18:
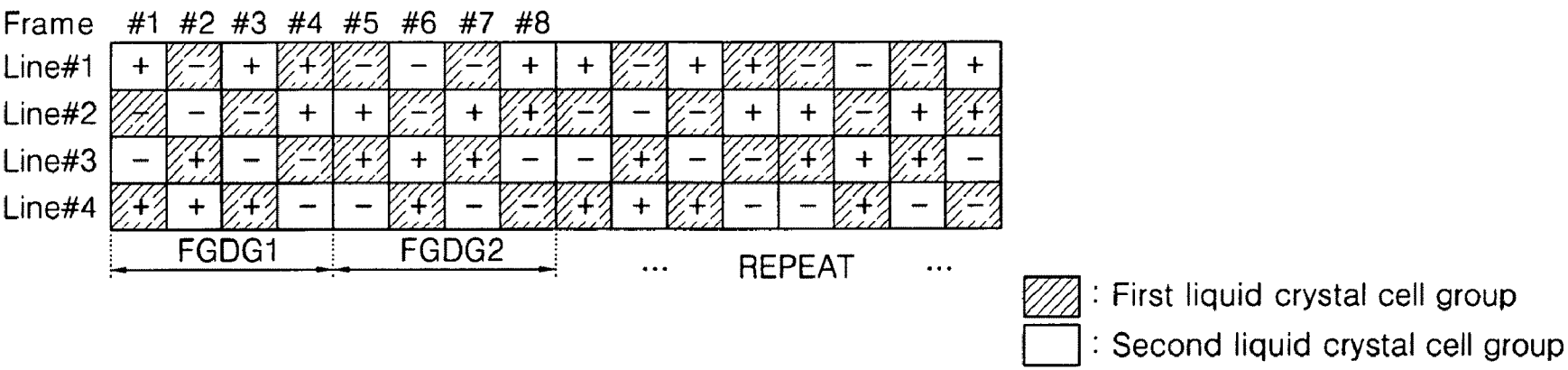
FIG. 18 illustrates a third embodiment of the method of driving the liquid crystal display and shows changes in a polarity of a data voltage charged to the liquid crystal cells.
Figure 19:
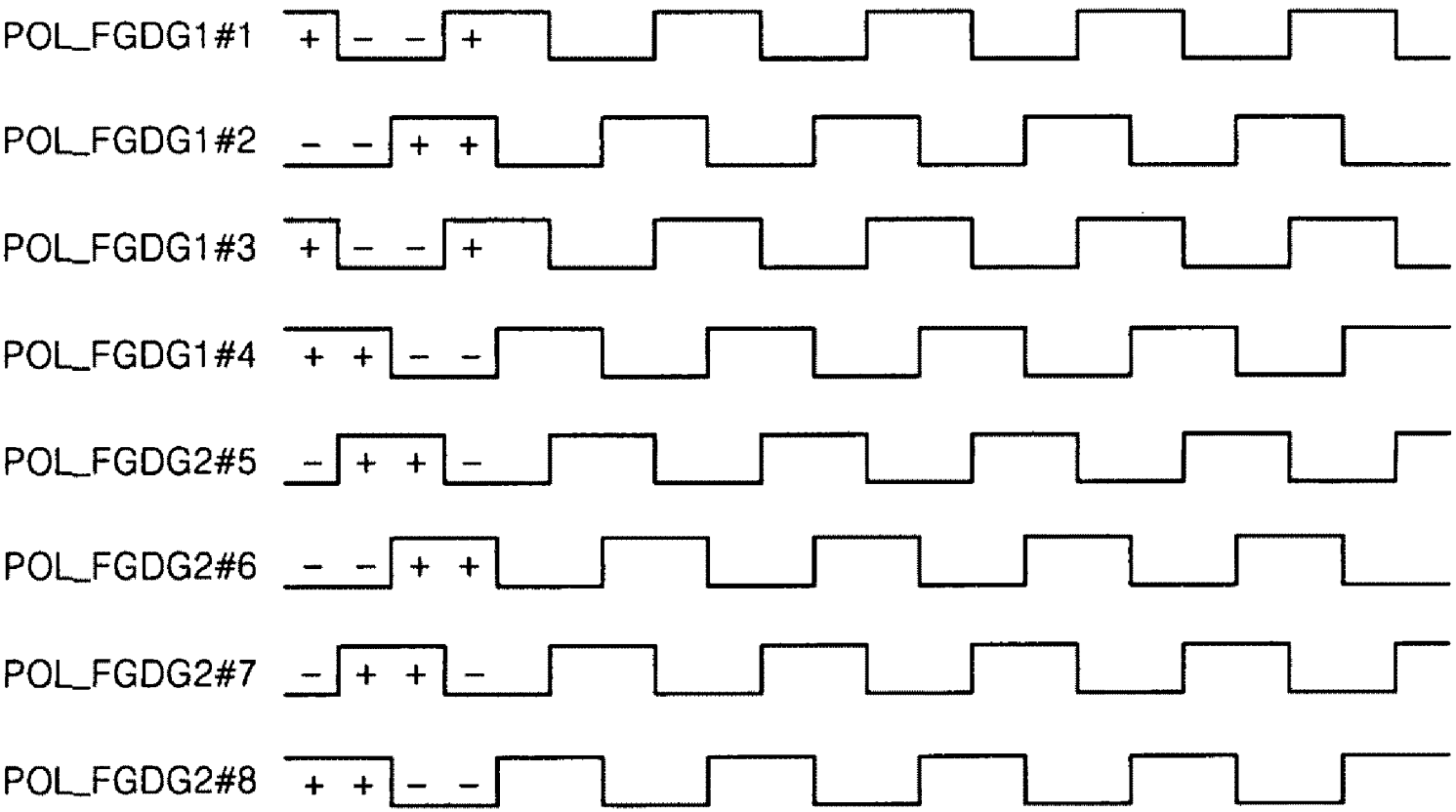
FIG. 19 is a waveform diagram showing a polarity control signal for controlling the polarity of the data voltage shown in FIG. 18.

FIGS. 18 and 19 show a third embodiment of the method of driving the liquid crystal display.

As shown in FIGS. 18 and 19, the liquid crystal cells include the liquid crystal cells belonging to a first liquid crystal cell group and the liquid crystal cells belonging to a second liquid crystal cell group which are alternately arranged. "+" indicates the liquid crystal cells charged to the positive polarity data voltage, and "−" indicates the liquid crystal cells charged to the negative polarity data voltage. A transverse axis indicates a frame period, namely, time, and a longitudinal axis indicates lines, namely, the display surface.

After the logic circuit 92 sequentially outputs polarity control signals POL_FGDG3#1 to POL_FGDG3#4 belonging to a third group during 4 frame periods, the logic circuit 92 sequentially outputs polarity control signals POL_FGDG4#1 to POL_FGDG4#4 belonging to a fourth group during 4 frame periods. In other words, the logic circuit 92 alternately outputs the polarity control signals POL_FGDG3#1 to POL_FGDG3#4 of the third group and the polarity control signals POL_FGDG4#1 to POL_FGDG4#4 of the fourth group every 4 frame periods. Hence, a location of the first liquid crystal cell group and a location of the second liquid crystal cell group change in each of first, fourth, fifth, and sixth frame periods #1, #4, #5, and #6, and thus the DC image sticking and the flicker can be prevented by suppressing the DC drive of the liquid crystal as shown in FIGS. 7 and 8. The liquid crystal cells of even-numbered rows are charged to the data voltage with the same polarity during two frame periods of second and third frame periods, and the liquid crystal cells of odd-numbered rows are charged to the data voltage with the same polarity during two frame periods of sixth and seventh frame periods. Hence, the nonuniform stains can be prevented by suppressing the DC drive of the liquid crystal as shown in FIGS. 5 and 6.

To generate the polarity control signals POL shown in FIG. 19, the first POL generation circuit 111 generates the first polarity control signal POL_FGDG3#1 of the third group whose a logic state is inverted in order of high, low, low, and high logic states until the liquid crystal cells of first to fourth horizontal lines Line#1 to Line#4 are scanned. Sequentially, after 4 frame periods elapse, the first POL generation circuit 111 generates the first polarity control signal POL_FGDG4#1 of the fourth group with a phase opposite a phase of the first polarity control signal POL_FGDG3#1 of the third group during a fifth frame period.

The second POL generation circuit 112 generates the second polarity control signal POL_FGDG3#2 of the third group whose logic state is inverted in an order of low, low, high, and high logic states until the liquid crystal cells of the first to fourth horizontal lines Line#1 to Line#4 are scanned. The second polarity control signal POL_FGDG3#2 of the third group has a phase shifted from the phases of the first polarity control signals POL_FGDG3#1 and POL_FGDG4#1 of the third and fourth groups by 1 horizontal period.

In the second and third embodiments, the second inverter 114 may be removed in the POL generation circuit 103 generating the polarity control signals.

The method of driving the liquid crystal display according to additional embodiments can obtain substantially the same effect as the above-described embodiments by alternately generating the polarity control signals of the second embodiment and the polarity control signals of the third embodiment and by controlling the data drive circuit 93.

It will be apparent to those skilled in the art that various modifications and variations can be made in the embodiments of the invention without departing from the spirit or scope of the invention. Thus, it is intended that the present invention cover the modifications and variations of this invention provided they come within the scope of the appended claims and their equivalents.

What is claimed is:

1. A liquid crystal display comprising:

a liquid crystal display panel including a plurality of data lines, a plurality of gate lines crossing the data lines, and a plurality of liquid crystal cells;

a data drive circuit that inverts a polarity of a data voltage supplied to the data lines in response to a polarity control signal;

a gate drive circuit that supplies a gate pulse to the gate lines; and a timing controller that generates the polarity control signal and controls the data drive circuit and the gate drive circuit, wherein the timing controller allows the polarity control signal to have a different phase in each frame and allows the liquid crystal cells to be divided into a first liquid crystal cell group charged to the data voltage of a same polarity during two frame periods and a second liquid crystal cell group charged during a current frame period to the data voltage with a polarity opposite a polarity of the data voltage charged during a previous frame period, wherein the liquid crystal cells belonging to the first liquid crystal cell group and the liquid crystal cells belonging to the second liquid crystal cell group are arranged on one screen of the liquid crystal display panel, and wherein the liquid crystal cells belonging to the first liquid crystal cell group are successively charged to the data voltage of the same polarity during three or more frame periods at intervals of a predetermined time equal to or longer than two frame periods.

2. The liquid crystal display of claim 1, wherein the polarity control signal includes:

first to fourth polarity control signals belonging to a first group;

first to fourth polarity control signals belonging to a second group generated subsequent to the first group;

first to fourth polarity control signals belonging to a third group generated subsequent to the second group; and first to fourth polarity control signals belonging to a fourth group generated subsequent to the third group.

3. The liquid crystal display of claim 2, wherein a phase of the second polarity control signal of the first group is shifted from a phase of the first polarity control signal of the first group by about one horizontal period, wherein a phase of the third polarity control signal of the first group is opposite to a phase of the first polarity control signal of the first group, and wherein a phase of the fourth polarity control signal of the first group is opposite to a phase of the second polarity control signal of the first group.

4. The liquid crystal display of claim 3, wherein a phase of the first polarity control signal of the second group is opposite to the phase of the first polarity control signal of the first group, wherein a phase of the second polarity control signal of the second group is the same as the phase of the second polarity control signal of the first group, wherein a phase of the third polarity control signal of the second group is opposite to the phase of the third polarity control signal of the first group, and wherein a phase of the fourth polarity control signal of the second group is the same as the phase of the fourth polarity control signal of the first group.

5. The liquid crystal display of claim 3, wherein a phase of the first polarity control signal of the third group is opposite to the phase of the first polarity control signal of the first group, wherein a phase of the second polarity control signal of the third group is opposite to the phase of the second polarity control signal of the first group, wherein a phase of the third polarity control signal of the third group is opposite to the phase of the third polarity control signal of the first group, and wherein a phase of the fourth polarity control signal of the third group is opposite to the phase of the fourth polarity control signal of the first group.

6. The liquid crystal display of claim 3, wherein a phase of the first polarity control signal of the fourth group is the same as the phase of the first polarity control signal of the first group, wherein a phase of the second polarity control signal of the fourth group is opposite to the phase of the second polarity control signal of the first group, wherein a phase of the third polarity control signal of the fourth group is the same as the phase of the third polarity control signal of the first group, and wherein a phase of the fourth polarity control signal of the fourth group is opposite to the phase of the fourth polarity control signal of the first group.

7. The liquid crystal display of claim 1, wherein the polarity control signal includes first to fourth polarity control signals belonging to a first group, and first to fourth polarity control signals belonging to a second group generated subsequent to the first group.

8. The liquid crystal display of claim 7, wherein a phase of the second polarity control signal of the first group is shifted from a phase of the first polarity control signal of the first group by about one horizontal period, wherein a phase of the third polarity control signal of the first group is opposite to the phase of the first polarity control signal of the first group, and wherein a phase of the fourth polarity control signal of the first group is opposite to the phase of the second polarity control signal of the first group.

9. The liquid crystal display of claim 7, wherein a phase of the first polarity control signal of the second group is opposite to a phase of the first polarity control signal of the first group, wherein a phase of the second polarity control signal of the second group is the same as a phase of the second polarity control signal of the first group, wherein a phase of the third polarity control signal of the second group is opposite to a phase of the third polarity control signal of the first group, and wherein a phase of the fourth polarity control signal of the second group is the same as a phase of the fourth polarity control signal of the first group.

10. A method of driving a liquid crystal display including a liquid crystal display panel having a plurality of data lines, a plurality of gate lines crossing the data lines, and a plurality of liquid crystal cells, a data drive circuit that inverts a polarity of a data voltage supplied to the data lines in response to a polarity control signal, a gate drive circuit that supplies a gate pulse to the gate lines, and a timing controller that generates the polarity control signal and controls the data drive circuit and the gate drive circuit, the method comprising:

allowing the polarity control signal to have a different phase in each frame and allowing the liquid crystal cells to be divided into a first liquid crystal cell group charged to the data voltage of the same polarity during two frame periods and a second liquid crystal cell group charged during a current frame period to the data voltage with a polarity opposite a polarity of the data voltage charged during a previous frame period; and arranging the liquid crystal cells belonging to the first liquid crystal cell group and the liquid crystal cells belonging to the second liquid crystal cell group on one screen and successively charging the liquid crystal cells belonging to the first liquid crystal cell group to the data voltage of the same polarity during three or more frame periods at intervals of predetermined time equal to or longer than two frame periods.

* * * * *